United States Patent [19]

Kiuchi et al.

[11] 4,206,064

[45] Jun. 3, 1980

[54] NEGATIVELY CHARGED TONER FOR DEVELOPING ELECTROSTATIC IMAGES CONTAINING METAL COMPLEX OF SALICYCLIC ACID COMPOUND AS CHARGE CONTROL AGENT

[75] Inventors: Masashi Kiuchi, Toride; Isamu Maki, Hoya, both of Japan

[73] Assignee: Canon Kabushiki Kaisha, Tokyo, Japan

[21] Appl. No.: 894,620

[22] Filed: Apr. 10, 1978

[30] Foreign Application Priority Data

Apr. 13, 1977 [JP] Japan ..... 52-42321

[51] Int. Cl.[2] ..... G03G 9/08

[52] U.S. Cl. ..... 430/106; 260/45.75 G; 260/45.75 N; 260/45.75 C; 430/110; 430/115

[58] Field of Search ..... 252/62.1; 96/1 SD; 260/DIG. 16, 45.75, 45.75 N, 45.75 C

[56] References Cited

U.S. PATENT DOCUMENTS

| | | | |
|---|---|---|---|
| 3,060,020 | 10/1962 | Greig | 252/62.1 P |
| 3,565,654 | 2/1971 | Story | 252/62.1 P |

OTHER PUBLICATIONS

Chemical Abstracts, vol. 69, col. 11962r, vol. 72, col. 113535h–applied, of interest: vol. 53/1690g, 55/P6841g, 59/P2580b/P7287g/P11163f.

*Primary Examiner*—John D. Welsh

*Attorney, Agent, or Firm*—Fitzpatrick, Cella, Harper & Scinto

[57] ABSTRACT

A toner for developing electrostatic images comprises a metal complex of salicylic acid or a metal complex of an alkyl salicylic acid as a charge controlling agent.

23 Claims, No Drawings

NEGATIVELY CHARGED TONER FOR DEVELOPING ELECTROSTATIC IMAGES CONTAINING METAL COMPLEX OF SALICYCLIC ACID COMPOUND AS CHARGE CONTROL AGENT

BACKGROUND OF THE INVENTION

1. Field of the Invention

This invention relates to a toner for developing electrostatic images, for example, in electrophotography and electrostatic printing.

2. Description of the Prior Art

Processes for developing electrostatic images can be generally divided into a liquid type process where a liquid developer composed of a fine toner dispersed in an electrically insulating layer and a dry type process where a fine toner composed of a natural or synthetic resin containing a dispersed colorant is used alone or in combination with a solid carrier.

Heretofore there are known various methods for visualizing electrostatic latent images with a toner such as a magneto-brush developing method is U.S. Pat. No. 2,874,063, a cascade developing method in U.S. Pat. No. 2,618,552, a powder cloud developing method in U.S. Pat. No. 2,221,776 and the like. As a developing toner used in these developing methods, there are used finely divided materials composed of dyestuffs or pigments dispersed in binders, and further, developing toners containing a third material in addition to the colorant and the binder such as those disclosed in Japanese Patent Publication Nos. 11096/1963, 10866/1965, 6398/1969 and the like.

Since a desirable charge on the toner particle can not be obtained by a binder resin alone, there is often used a dyestuff, pigment or tribo controlling agent for imparting a desirable charge. At present, nigrosine series dyestuffs are used for imparting positive charge, and metal-containing dyestuffs as disclosed in Japanese Patent Publication No. 26478/1970 are used for imparting negative charge. These dyestuffs are much better than conventional charge controlling agents with respect to imparting a charge to toner. These dyestuffs are, however, disadvantageously colored materials.

In general, toners used for multicolor electrophotography must have particular limited colors such as yellow, magenta and cyan. It is clear that bluish purple nigrosine series dyestuffs or metal-containing dyestuffs can not be used as a charge control agent for the toners in multicolor electrophotography. It is, therefore, necessary to use a charge controlling agent which is colorless or substantially colorless such as light color.

Another disadvantage of conventional toner having a binder resin containing a dyestuff or pigment is that the toner shows good developing characteristics at the beginning but rapidly loses such good characteristics.

The reason is that such dyestuff or pigment is not compatible with the binder resin or is of low wettability with respect to the binder resin. In other words, according to conventional methods of producing toners, a binder resin, a colorant, a charge controlling dyestuff or pigment and others are mixed and melted and finely divided to powders of about 1-50 microns in size. In this procedure, there are formed powders which components are not uniform and fine particles composed of the charge controlling dyestuff or pigment only. These fine particles composed of only the charge controlling dyestuff or pigment adversely affect the life of the developer.

Such undesirable charge controlling fine particles are formed in a step where a developer is used in a copier. During the developing step, the developer is continuously stirred and rubbed against an electrostatic latent image retaining surface such as a surface of a photosensitive member and therefore, bare charge controlling fine particles on the surface of a toner particle which is hardly wetted by the binder resin fall from the toner particle. The charge controlling fine particles are apt to generate intensely triboelectric charge with such a carrier as iron and therefore, strongly and electrically attach to such a carrier. As the result, amount of triboelectric charge between the carrier and the toner decreases or the polarity becomes unstable, or electric resistance of the carrier such as iron powder increases, and thereby, the density of images decreases and fog is formed and further, edge effects appear.

SUMMARY OF THE INVENTION

An object of the present invention is to provide a toner free from the above mentioned drawbacks.

Another object of the present invention is to provide a toner of a durable and stable electric chargability.

A further object of the present invention is to provide a toner containing a colorless or substantially colorless charge controlling agent.

Still another object of the present invention is to provide a toner which contains uniform composition and has a stable polarity and triboelectric charge.

A still further objects of the present invention is to provide a toner which, even after a long use, gives good images of a non-reduced density and forms neither fog nor edge effects.

According to the present invention, the toner for developing electrostatic images comprises a binder and a metal complex of salicyclic acid or a metal complex of an alkyl salicylic acid as a charge controlling agent.

DESCRIPTION OF THE PREFERRED EMBODIMENTS

The metal complex of sabicyclic acid or an alkyl salicylic acid used in the present invention may be prepared by known processes. For example, the chromium complex may be prepared as shown below.

Salicyclic acid or an alkyl salicylic acid is dissolved is a solvent such as methanol, ethanol, ether, ketone and the like, and an aqueous solution of chromic sulfate. Molar ratio of salicylic acid to chromium is 2:1. Then an aqueous alkali is added to adjust the pH and the mixture is refluxed for about 3 hours and the resulting precipitate is filtered and collected. The precipitate may be represented by the following formula.

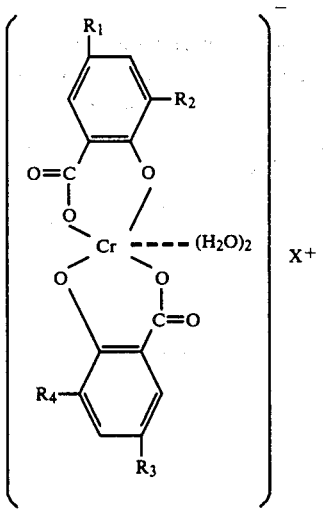

where $R_1$, $R_2$, $R_3$ and $R_4$ are, similar or dissimilar, and selected from the group consisting of hydrogen and alkyl, and $X^+$ is a counter ion.

The counter ion may be changed depending upon post-treatment of the precipitate. For example, when the precipitate is washed with a diluted sulfuric acid until pH of the solution becomes 6–7, the resulting counter ion is hydrogen ion. When aqueous sodium hydroxide is used in place of the diluted sulfuric acid and the pH is brought to 8–10, the resulting counter ion is sodium ion. Further, when the precipitate having sodium ion as a counter ion is treated with various amine hydrochlorides, there are produced various ammonium ions.

$X^+$ is preferably selected from hydrogen, alkali metal such as sodium and potassium, and various ammonium ions.

As alkyl groups of $R_1$, $R_2$, $R_3$, and $R_4$, alkyl groups having not more than five carbon atoms can be easily introduced into the benzenoid moiety. Tertiary amyl, tertiary butyl or alkyl having a lesser number of carbon atoms may be introduced. The introduction of alkyl group(s) serves to improve the compatibility with a binder resin.

In addition to the chromium complex as above, there may be prepared nickel, cobalt and copper complexes in a similar way. These complexes have a charge controlling ability similar to the chromium complex, but are somewhat colored as compared with the chromium complex.

The toner according to the present invention contains a binder as well as the charge controlling agent, and further may contain a colorant.

Representative binders are homopolymers of styrene or substituted styrene such as polystyrene, poly-p-chlorostyrene, polyvinyltoluene and the like, sturene copolymers such as sturene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylic acid copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, and the like, polyvinyl chloride, polyvinyl acetate, polyethylene, polypropylene, silicone resin, polyester, polyurethane, polyamide, epoxy resins, polyvinyl butyral, rosin, modified rosin, terpene resins, phenolic resins, xylene resins, aliphatic or alicyclic hydrocarbon resins, aromatic series petroleum resins, chlorinated paraffin, paraffin waxes and the like.

These binders may be used alone or in combination.

As a colorant, there may be used conventional dyestuffs and pigments for toners for electrophotography.

For example, carbon black (C.I. 77266), iron black, metal complex dyes, chrome yellow (C.I. 14095, 14025), Hansa yellow (C.I. 11680, 11710), benzidine yellow (C.I. 21090, 21095, 21100), red iron oxide, quinacridone series pigments (C.I. Pigment red 122), rhodamine series pigments (C.I. Pigment red 81), aniline red, brilliant carmine 6B (C.I. 15850), prussian blue, ultramarine, phthalocyanine blue (C.I. 74160, 74180, 74100) and the like.

When toners for multicolor images, such as yellow, magenta and cyan toners are necessary, it is preferable to use the following colorants in combination.

As a colorant for yellow toner, benzidine series yellow organic pigments (3,3'-dichlorobenzidine derivatives) are preferable. For example, there may be mentioned Color Index No. 21090 (for example, commercially available Pigment Yellow 12 and Symuler Fast Yellow GF), C.I. 21095 (for example, Pigment Yellow 14, Benzidine Yellow G, Benzidine Yellow I.G., Vulcan Fast Yellow G, Benzidine Yellow OT, Symuler Fast Yellow 5GF), C.I. 21100 (for example, Pigment Yellow 13, Benzidine Yellow GR, Permanent Yellow GR, Symuler Fast Yellow GRF), monoazo dyes (for example, C.I. Solvent Yellow 16), nitrophenylamine sulfoneamide (C.I. Disperse Yellow 33) and the like.

As a colorant for magenta toner, quinacridone series magenta organic pigments and rhodamine series magenta organic pigments are preferable. For example, there may be mentioned Pigment Red C.I. 122 (for example, Permanent Pink E, Fastgen and Super Magenta RS), Pigment Red C.I. 81 (for example, Seikalite Rose 81, Symulex Rohodamine Y, and Irgalite Brillred TCR), anthraquinone dyes, and diazo dyes (C.I. Solvent Red 19).

As a colorant for cyan toner, phthalocyanine series cyan organic pigments are preferable. For example, there may be mentioned copper phthalocyanine (C.I. Pigment Blue 15), Indanthrene Blue, C.I. Nos. 74100, 74250, 74260, 74280, 74255, 74160, and 74180.

Among the colorants, benzidine series yellow organic pigment, quinacridone series magenta organic pigment and copper phthalocyanine are preferable as yellow, magenta and cyan, respectively.

Heretofore, when negatively chargeable toners are prepared by using these colorants, unsaturated polyester resins prepared from bisphenol A and fumaric acid are preferably employed as a binder resin because these resins facilitate to produce a negative charge while other binder resins give zero charge or can not give a stable charge. However, even when the unsaturated polyester resin is used, durability of toner is so poor that image density varies to a great extent, fog increases and disturbed images are formed after several hundred to a thousand sheets of copy are made.

The present inventors have found a new method for evaluating durability of toner by modelling the impact applied by agitation caused during a development procedure. This method serves to select easily a toner of a high durability and a long life.

This method is carried out by placing a developer in a ball-mill pot of about 2 liters of inner volume, rotating the pot at 50 r.p.m. and measuring the amount of triboelectric charge and the V-D characteristic as a time lapses. If the amount of triboelectric charge and the V-D (surface potential-image density) characteristic are stable, the developer is regarded as an excellent developer having a resistance to mechanical agitation.

According to this method, for example, chromium complex of salicylic acid was incorporated into a toner and various binders were tested. As the result, it has been found that toners of an excellent durability can be obtained by incorporating a metal complex of salicylic acid or an alkyl salicylic acid.

Among the binder resins, homopolymers and copolymers of styrene and epoxy resins are preferable.

Toners of the present invention show an excellent durability in a continuous copying by a color copier, and further, are suitable for an electrostatic process for printing textiles.

Amount of the metal complex used in the present invention is generally 0.1–10 parts by weight, preferably 0.5–4 parts by weight per 100 parts by weight of a binder.

The toner of the present invention may form a developer when mixed with a carrier. As the carrier, there may be used conventional carriers. For example, as a solid carrier, there may be used magnetic powders such as iron powders and glass beads and glass beads which surface is treated with a resin.

The following examples are given for illustrating the present invention, but by no means for limiting the present invention.

EXAMPLE 1

250 g. of 3,5-di-t-butyl salicylic acid was dissolved in 2250 g. of methanol, and 255 g. of a 40% aqueous $Cr_2(SO_4)_3$ was added thereto. And about 240 g. of 25% aqueous sodium hydroxide was added to adjust the pH to 4–5. The resulting solution was refluxed at about 70° C. for 3 hours to produce a precipitate slightly tinted in green, and filtered at about 50° C. to collect the precipitate. The cake thus collected was washed with 1% aqueous sulfuric acid and then with water until the pH became 6–7, and dried. Thus chromium complex of 3,5-di-t-butyl salicylic acid (hereinafter referred to as "Cr-2") was obtained in 75% yield.

A toner was prepared by using Cr-2 as shown below.

| | |
|---|---|
| Epoxy resin (Epikote 1004, tradename, supplied by Shell Chemical Co.) | 100 parts by weight |
| Copper phthalocyanine (C.I. Pigment Blue 15) | 4 parts by weight |
| Cr-2 | 1 part by weight |

These components were uniformly pre-mixed for 24 hours by a ball-mill, then kneaded by a heating roll mill, roughly ground by a hammer mill, and finely pulverized by a jet mill to produce a powder toner of 1–40 microns in size. 10 parts by weight of the resulting toner and 90 parts by weight of iron powder (EFV 250–400, tradename, supplied by Nihon Teppun, Japan) were mixed to form a developer. The resulting developer was tested by repeatedly copying with a commercially available dry type electrophotographic copier (NP-1100, tradename, supplied by Canon Kabushiki Kaisha, Japan), and images of high quality were obtained and any change of image density was not observed until 10000 sheets of copy were produced.

REFERENCE EXAMPLE 1

Repeating the procedures in Example 1 except that the Cr-2 is not contained, a toner was produced and tested.

The toner gave foggy and poor images.

The toner of Reference Example 1 and that of Example 1 were compared by the above mentioned model experiment of testing durability. The change of the triboelectric charge was determined as a time lapses (the amount of triboelectric charge was measured by Blow-off method).

The results are shown in Table 1 below.

Table 1

| Ball mill rotating time | Change of amount of triboelectric charge (μc/g) with lapse of time: Begin-nings | After one hour | After 3 hours | After 5 hours | After 24 hours |
|---|---|---|---|---|---|
| Example-1 | −5.4 | −4.8 | −5.0 | −5.1 | −5.5 |
| Reference Example-1 | +4.1 | +3.5 | +2.4 | +1.7 | +0.5 |

This table shows that Cr-2 imparts negative charge to the toner and the negative charge is highly stable during mechanical agitation.

EXAMPLES 2–5 and REFERENCE EXAMPLE 2

Repeating the procedures of Example 1 except that each particular formula was employed in place of that in Example 1, toners of Examples 2–5 and Reference Example 1 were obtained.

Change of amount of triboelectric charge with lapse of time is shown in Table 2 below. The polyester in the examples is a polymer prepared from bisphenol A and a fumaric acid ester.

Table 2

| Example No. | Formula (parts by weight) | | Change of amount of triboelectric charge with lapse of time: Amount of Triboelectric charge (μc/g): Beginnings | one hour | 3 hours | 5 hours | 24 hours |
|---|---|---|---|---|---|---|---|
| 2 | Polyester | 100 | | | | | |
| | 2,9-Dimethylquinacridone | 4 | −6.6 | −6.9 | −6.1 | −5.9 | −6.3 |
| | Cr-2 | 2 | | | | | |
| Reference Example 2 | Polyester | 100 | | | | | |
| | 2,9-Dimethylquinacridone | 4 | −7.5 | −4.1 | −309 | −3.4 | −1.9 |

Table 2-continued

| Example No. | Formula (parts by weight) | | Change of amount of triboelectric charge with lapse of time: Amount of Triboelectric charge (μc/g) Beginnings | one hour | 3 hours | 5 hours | 24 hours |
|---|---|---|---|---|---|---|---|
| 3 | Polyester | 100 | | | | | |
| | 2,9-Dimethylquinacridone | 4 | −7.0 | −6.8 | −6.9 | −6.0 | −6.4 |
| | Cr-2 | 1 | | | | | |
| 4 | Polyester | 100 | | | | | |
| | 2,9-Dimethylquinacridone | 4 | −7.2 | −7.0 | −5.1 | −4.4 | −4.5 |
| | Cr-2 | 0.5 | | | | | |
| 5 | Polyester | 100 | | | | | |
| | 2,9-Dimethylquinacridone | 4 | −7.5 | −6.1 | −4.6 | −4.0 | −3.2 |
| | Cr-2 | 0.2 | | | | | |

From Table 2 above, it is clear that Cr-2 serves to impart a stable negative charge to the toner.

EXAMPLE 6

Repeating the procedures of Example 1 except that mono-t-butyl salicylic acid was used in place of 3,5-di-t-butyl salicylic acid, there was produced a chromium complex (hereinafter referred to as "Cr-1").

Following the procedure of Example 1, a toner composed of the following components was prepared.

| | Parts by weight |
|---|---|
| Styrene-butadiene copolymer (Molar ratio of styrene to butadiene being 85:15) | 50 |
| Chlorinated paraffin (Degree of chlorination:70%) | 50 |
| Carbon black (Regal 400R, tradename, supplied by Cabot Co.) | 6 |
| Cr-1 | 4 |

REFERENCE EXAMPLE 3

Repeating the procedures of Example 6 except that Cr-1 was absent there was obtained a toner.

In a way similar to Example 1, each of the toners of Example 6 and Reference Example 3 (12 parts by weight) and iron powder (88 parts by weight) were mixed to produce a developer.

The developer derived from Example 6 was tested by using a commercially available electrophotographic copier (NP-5000, tradename, supplied by Canon Kabushiki Kaisha). The image density was kept at 1.3–1.5 until 50,000 copies were made, and no fog was observed and the potential at the dark portion was kept at from +450 V to +480 V.

The developer derived from Reference Example 3 was tested in the same way as above, but any practical images were not obtained from the beginning.

Both developers were subjected to a model experiment as mentioned above so as to compare them with respect to the change of triboelectric charge with lapse of time. The result is as shown in Table 3 below.

Table 3

| Ball-mill time | Beginnings | one hour | 3 hours | 5 hours | 24 hours |
|---|---|---|---|---|---|
| Example 6 | −8.2 | −7.9 | −7.5 | −6.8 | −7.1 |
| Working Example 3 | −0.7 | −2.2 | −4.0 | −3.5 | −1.8 |

Toners prepared following the procedure of Example 6 except that other styrene copolymers were used in place of the styrene-butadiene copolymer were tested and similar results to Example 6 were obtained. Further, when a phenolic resin was used in place of chlorinated paraffin in Example 6, a result similar to Example 6 was obtained.

In addition, when Ni or Co was substituted for Cr in the complex, the toner showed a stable triboelectric charge.

EXAMPLES 7–9 and REFERENCE EXAMPLES 4–6

Repeating the procedure of Example 1 except that each of the formulas in Table 4 below was used in place of formula for Example 1, there were obtained toners, and change of triboelectric charge of these toners was measured as shown in Table 4. It is clear from said Table that triboelectric charge of the toner according to the present invention is stable.

Table 4

| Example No. | Formula (parts by weight) | | Amount of triboelectric charge (μc/g) Beginnings | one hour | 3 hours | 5 hours | 24 hours |
|---|---|---|---|---|---|---|---|
| 7 | Styrene oligomer | 100 | | | | | |
| | 2,9-Dimethylquinacridone | 5 | −6.1 | −6.3 | −5.8 | −5.8 | −6.0 |
| | Cr-1 | 6 | | | | | |
| Reference Example 4 | Styrene oligomer | 100 | | | | | |
| | 2,9-Dimethylquinacridone | 5 | +2.0 | +2.9 | +4.5 | +6.7 | +7.7 |
| 8 | Styrene oligomer | 100 | | | | | |
| | Copper phthalocyanine (C.I. Pigment Blue-15) | 4.5 | −5.2 | −5.0 | −5.5 | −4.8 | −4.6 |
| | Cr-1 | 3 | | | | | |
| Reference Example 5 | Styrene oligomer | 100 | | | | | |
| | Copper phthalocyanine (C.I. Pigment Blue-15) | 4.5 | +3.1 | +3.5 | +3.9 | +4.5 | +5.0 |
| 9 | Styrene oligomer | 100 | | | | | |
| | Benzidine Yellow (C.I. Pigment Yellow-12) | 4 | −7.3 | −7.9 | −8.2 | −7.7 | −7.6 |
| | Cr-1 | 2 | | | | | |
| Reference | Styrene oligomer | 100 | | | | | |

Table 4-continued

| Example No. | Formula (parts by weight) | | Amount of triboelectric charge (μc/g) Beginnings | one hour | 3 hours | 5 hours | 24 hours |
|---|---|---|---|---|---|---|---|
| Example 6 | Benzidine Yellow | 4 | −7.4 | −3.2 | −3.9 | −3.3 | −2.5 |

EXAMPLE 10

Chromium complexes of salicylic acid and ethyl salicylic acid were prepared, and toners were prepared following the procedures of Examples 1–9 except that each of the above mentioned chromium complexes was used in place of mono- or di-t-butyl salicylic acid.

Change of triboelectric charge of each of the toners thus produced was almost similar to that of Examples 1–9.

What we claim is:

1. A negatively charged toner for developing electrostatic images which comprises a binder resin and a member selected from the group consisting of a metal complex of salicylic acid and a metal complex of an alkyl salicylic acid as a charge controlling agent.

2. A toner according to claim 1 in which the alkyl salicylic acid has an alkyl group having not more than 5 carbon atoms.

3. A toner according to claim 1 in which the metal complex of salicylic acid or the metal complex of an alkyl salicylic acid is present in an amount of 0.1–10 parts by weight per 100 parts by weight of the binder resin.

4. A toner according to claim 1 in which the metal complex is a chromium complex.

5. A toner according to claim 1 in which the metal complex is selected from the group consisting of nickel complexes and cobalt complexes.

6. A toner according to claim 1 further comprising a colorant.

7. A toner according to claim 6 in which the colorant is selected from the group consisting of dyes and pigments.

8. A toner according to claim 7 in which the colorant is a yellow colorant for electrophotography.

9. A toner according to claim 8 in which the yellow colorant is a benzidine series yellow organic pigment.

10. A toner according to claim 7 in which the colorant is a magenta colorant for electrophotography.

11. A toner according to claim 10 in which the magenta colorant is a quinacridone series magenta organic pigment.

12. A toner according to claim 7 in which the colorant is a cyan colorant for electrophotography.

13. A toner according to claim 12 in which the cyan colorant is copper phthalocyanine.

14. A toner according to claim 7 in which the colorant is carbon black.

15. A negatively charged toner for developing electrostatic images which consists essentially of a binder resin, a colorant and a charge controlling agent selected from the group consisting of a metal complex of salicylic acid and a metal complex of an alkyl salicylic acid, the charge controlling agent being present in an amount of 0.1–10 parts by weight per 100 parts by weight of the binder resin.

16. A toner according to claim 15 in which the binder resin is selected from the group consisting of homopolymers and copolymers of styrene and epoxy resins, and the metal complex of an alkyl salicylic acid is a chromium complex of the formula

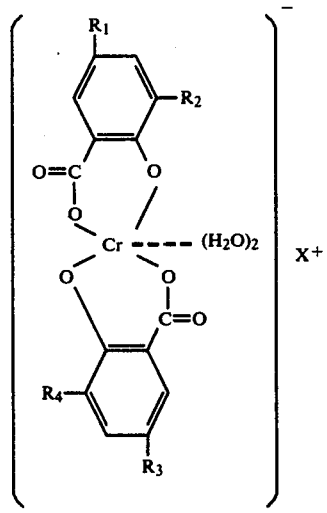

where $R_1$, $R_2$, $R_3$ and $R_4$ are selected from the group consisting of hydrogen and alkyl having not more than 5 carbon atoms, at least one of $R_1$, $R_2$, $R_3$ and $R_4$ being the alkyl, and $X^+$ is selected from the group consisting of hydrogen and alkali metal ions.

17. A toner according to claim 16 in which the colorant is a yellow colorant for electrophotography.

18. A toner according to claim 17 in which the yellow colorant is a benzidine series yellow organic pigment.

19. A toner according to claim 16 in which the colorant is a magenta colorant for electrophotography.

20. A toner according to claim 19 in which the magenta colorant is a quinacridone series magenta organic pigment.

21. A toner according to claim 16 in which the colorant is a cyan colorant for electrophotography.

22. A toner according to claim 21 in which the cyan colorant is a copper phthalocyanine.

23. A toner according to claim 1 wherein the binder resin is a homopolymer or copolymer of a member selected from a group consisting of styrene and epoxy resins.

* * * * *